US008328327B2

(12) United States Patent
Sugahara

(10) Patent No.: US 8,328,327 B2
(45) Date of Patent: Dec. 11, 2012

(54) LIQUID EJECTION APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 374 days.

(21) Appl. No.: 12/646,696

(22) Filed: Dec. 23, 2009

(65) Prior Publication Data

US 2010/0165041 A1 Jul. 1, 2010

(30) Foreign Application Priority Data

Dec. 26, 2008 (JP) ..... 2008-334818

(51) Int. Cl.
*B41J 2/165* (2006.01)

(52) U.S. Cl. ..... 347/36; 347/30; 347/51; 347/95

(58) Field of Classification Search ..... None
See application file for complete search history.

(56) References Cited

U.S. PATENT DOCUMENTS

| | | | |
|---|---|---|---|
| 2007/0013757 | A1 | 1/2007 | Ohnishi |
| 2007/0046764 | A1 | 3/2007 | Nakazawa |
| 2008/0074484 | A1 | 3/2008 | Sugahara |

FOREIGN PATENT DOCUMENTS

| | | | |
|---|---|---|---|
| JP | 2003-182111 | A | 7/2003 |
| JP | 2003-211705 | A | 7/2003 |
| JP | 2004-155047 | A | 6/2004 |
| JP | 2004-358769 | A | 12/2004 |
| JP | 2007-055002 | A | 3/2007 |
| JP | 2007-125713 | A | 5/2007 |
| JP | 2007-230007 | A | 9/2007 |
| JP | 2008-105403 | A | 5/2008 |

OTHER PUBLICATIONS

Machine translation of JP 2007-125713 A.*
Translation of JP 2007-125713 A.*
Japan Patent Office, Notice of Reasons for Rejection for Japanese Patent Application No. 2008-334818 (counterpart to above-captioned patent application), mailed Dec. 7, 2010.

* cited by examiner

*Primary Examiner* — Matthew Luu
*Assistant Examiner* — Justin Seo
(74) *Attorney, Agent, or Firm* — Baker Botts L.L.P.

(57) ABSTRACT

A liquid ejection apparatus includes: a liquid ejection head which ejects photo-curable liquid from nozzles; a first light applicator which applies light to an ejection target having received liquid ejected by the liquid ejection head; a waste tank which reserves therein liquid discharged from the liquid ejection head; and a second light applicator which applies light to liquid in the waste tank.

6 Claims, 10 Drawing Sheets

LIQUID EJECTION APPARATUS

CROSS REFERENCE TO RELATED APPLICATION

The present application claims priority from Japanese Patent Application No. 2008-334818, which was filed on Dec. 26, 2008, the disclosure of which is herein incorporated by reference in its entirety.

BACKGROUND OF THE INVENTION

1. Field of the Invention

The present invention relates to a liquid ejection apparatus which ejects photo-curable liquid from nozzles.

2. Description of Related Art

In an ink jet printer having an ink jet head and a UV (ultraviolet) light source unit which are carried on a carriage reciprocating along a guide rod in a scanning direction, it has been known that printing on a recording medium is conducted in the following manner: UV curable ink is ejected onto the recording medium from the ink jet head which reciprocates with the carriage in the scanning direction, so that the ejected ink is landed on the recording medium; and the ink landed on the recording medium is cured by ultraviolet light applied from the UV light source unit which also reciprocates with the carriage in the scanning direction. It has been also known that such an ink jet printer performs a purging process, a process of sucking ink in the ink jet head using a purge cap which covers a nozzle surface of the ink-jet head during this process.

SUMMARY OF THE INVENTION

To the ink jet printer which performs the above-described purging process, it is necessary to provide a waste tank for reserving ink sucked from the ink jet head in the purging process. In the case where the waste tank reserves ink therein, the ink in the waste tank possibly leaks to the outside, for example when carrying the ink jet printer.

An object of the present invention is to provide a liquid ejection apparatus which ejects photo-curable liquid and is capable of preventing liquid in a waste tank from leaking to the outside.

The present invention provides a liquid ejection apparatus, including: a liquid ejection head which ejects photo-curable liquid from nozzles; a first light applicator which applies light to an ejection target having received liquid ejected by the liquid ejection head; a waste tank which reserves therein liquid discharged from the liquid ejection head; and a second light applicator which applies light to liquid in the waste tank.

According to the present invention, it is possible to cure liquid discharged to the waste tank. This makes it possible to prevent the liquid in the waste tank from leaking to the outside, for example when carrying the liquid ejection apparatus.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention.

Figure 1A:
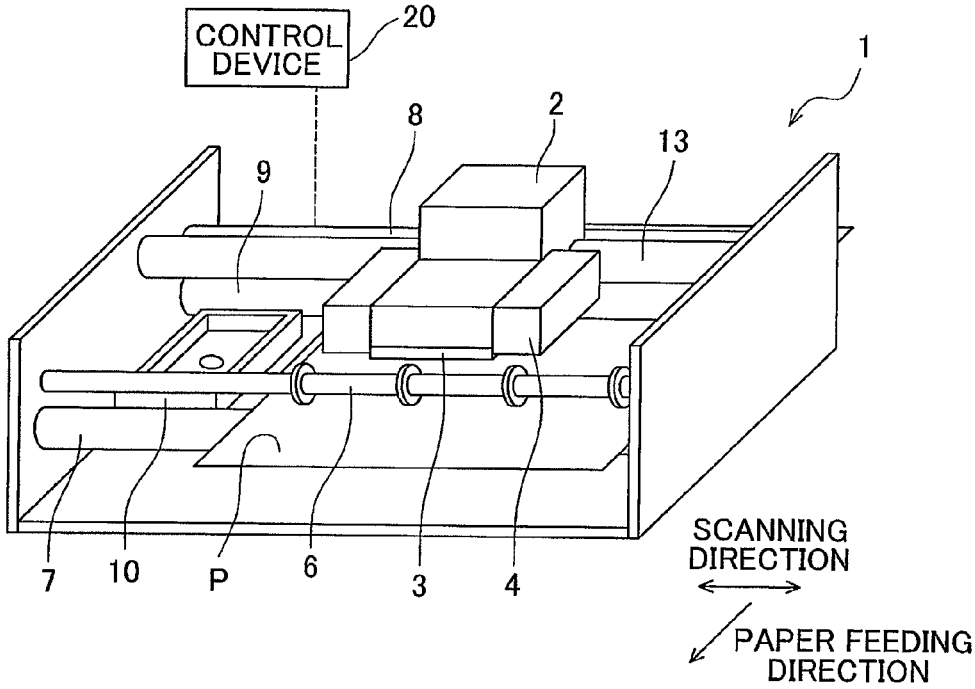
FIG. 1A is a schematic diagram of a printer of an embodiment of the present invention, with a recording sheet placed on a platen.
Figure 1B:
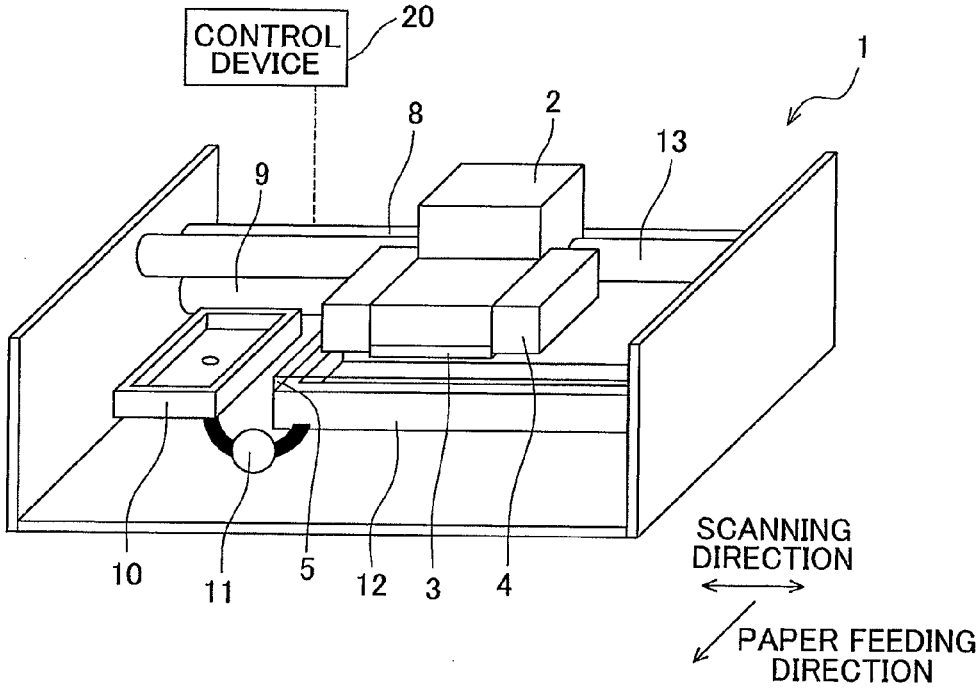
FIG. 1B is a schematic diagram of the printer of the embodiment of the present invention, without a recording sheet placed on the platen.
Figure 2:
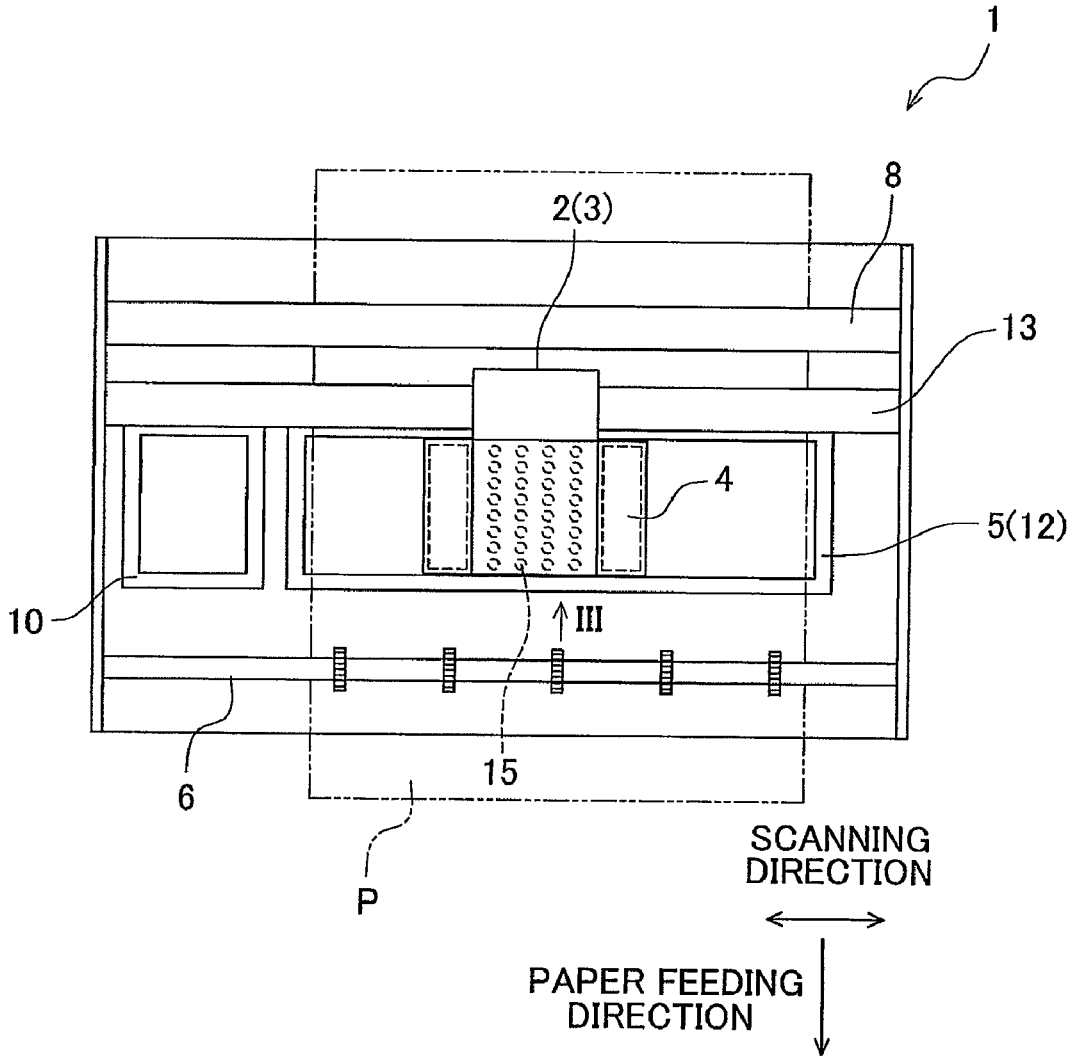
FIG. 2 is a plan view of FIGS. 1A, 1B.
Figure 3A:
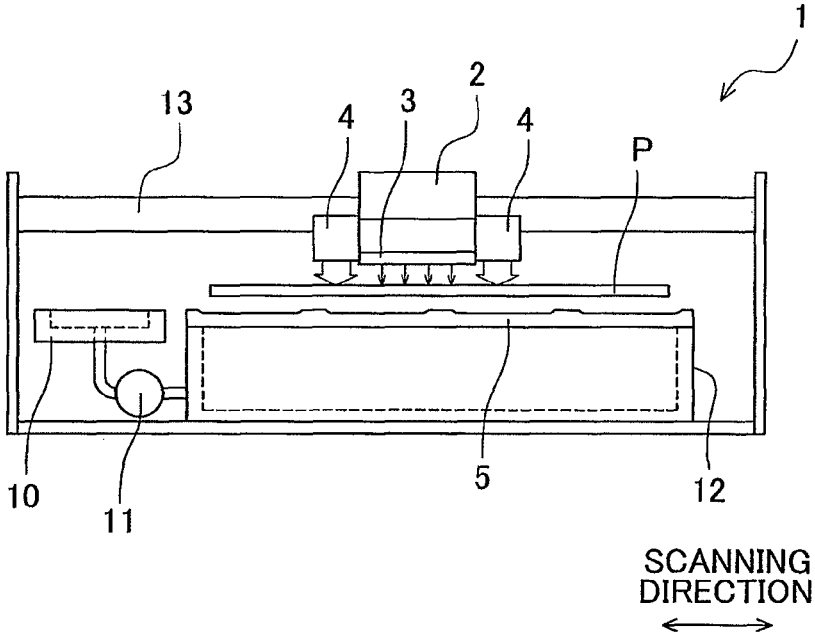
FIG. 3A is a diagram of the printer of FIG. 2 which performs a printing process, viewed from a direction of an arrow III in FIG. 2.
Figure 3B:
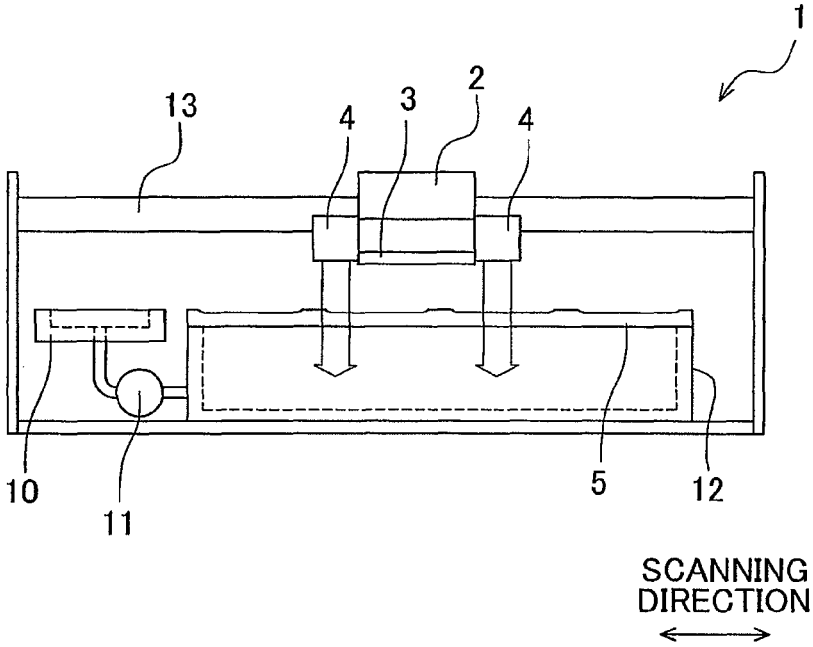
FIG. 3B is a diagram of the printer of FIG. 2 which performs a process of applying ultraviolet light to a waste tank, viewed from the direction of the arrow III in FIG. 2.

FIG. 1A is a schematic diagram of a printer of this embodiment, with a recording sheet P placed on a later-described platen 5. FIG. 1B is a schematic diagram of the printer of this embodiment, without a recording sheet P placed on the platen 5. FIG. 2 is a plan view of FIGS. 1A, 1B. FIG. 3A is a diagram of the printer of FIG. 2 which performs a printing process (will be described later), viewed from a direction of an arrow III in FIG. 2. FIG. 3B is a diagram of the printer of FIG. 2 which performs a process of applying ultraviolet light to a later-described waste tank 12, viewed from the direction of the arrow III in FIG. 2. Note that in FIG. 1B, later-described conveyor rollers 6 and 7 are omitted.

A printer 1, which is a liquid ejection apparatus, is a portable printer of relatively small size. As shown in FIGS. 1A, 1B, 2, 3A, and 3B, the printer 1 includes: a carriage 2; an ink-jet head 3 which is a liquid ejection head; two UV applicators 4 serving as both a first light applicator and a second light applicator; the platen 5 which is a support member; conveyor rollers 6 to 9; a suction cap 10; a pump 11; the waste tank 12; and the like. The operation of the printer 1 is controlled by a control device 20.

The carriage 2 reciprocates along a guide shaft 13 extending in a scanning direction which is a horizontal direction in FIGS. 1A, 1B. The ink jet head 3 is disposed on an under surface of the carriage 2, i.e., is carried by the carriage 2. The ink-jet head 3 ejects UV curable ink which is photo-curable liquid from nozzles 15 formed on its under surface, onto a recording sheet P which is an ejection target. The two UV applicators 4 are respectively disposed on both side surfaces of the carriage 2 in the scanning direction. That is, the two UV applicators 4 are carried by the carriage 2. Each of the UV applicators 4 has a UV light source, and applies ultraviolet light to a recording sheet P or the platen 5 which closes an opening of the later-described waste tank 12.

The platen 5 is disposed below the carriage 2 so that the platen 5 faces the ink jet head 3 and the UV applicators 4. The platen 5 supports a recording sheet P, to which ink is ejected from the ink jet head 3 and ultraviolet light is applied from the UV applicators 4, from a lower side of the sheet P. That is, the platen 5 supports the sheet P from a side opposite to the ink-jet head 3 and the UV applicators 4. In addition, the platen 5 is made of transparent material, that is, light transmissive material. Therefore, ultraviolet light applied from the UV applicators 4 to the platen 5 passes through the platen 5 and reaches below the platen 5. The conveyor rollers 6 to 9 convey a recording sheet P supported by the platen 5 in a paper feed direction that is a direction toward a viewer in FIG. 1A.

The suction cap 10 is disposed at the left of and adjacent to the platen 5, and is configured to be movable in a vertical direction. This configuration allows the suction cap 10 to cover a nozzle surface of the ink jet head 3 when the suction cap 10 is moved upward while the ink jet head 3 is at a position where the ink-jet head 3 faces the suction cap 10.

The pump 11 is connected to the suction cap 10. The suction cap 10 and the pump 11 are provided for performing a purging process which will be described later, and these members correspond to a purging mechanism of the present invention.

The waste tank 12 is disposed below the platen 5, that is, opposite to the UV applicators 4 with the platen 5 interposed therebetween. The waste tank 12 reserves therein ink discharged in a flushing or purging process described later. In addition, the waste tank 12 has the opening on its upper surface (i.e., is open-topped), and the platen 5 is disposed so as to close the opening. Thereby, ultraviolet light applied from the UV applicators 4 to the platen 5 passes through the transparent platen 5, and is applied to the waste tank 12 located below the platen 5.

Figure 4:
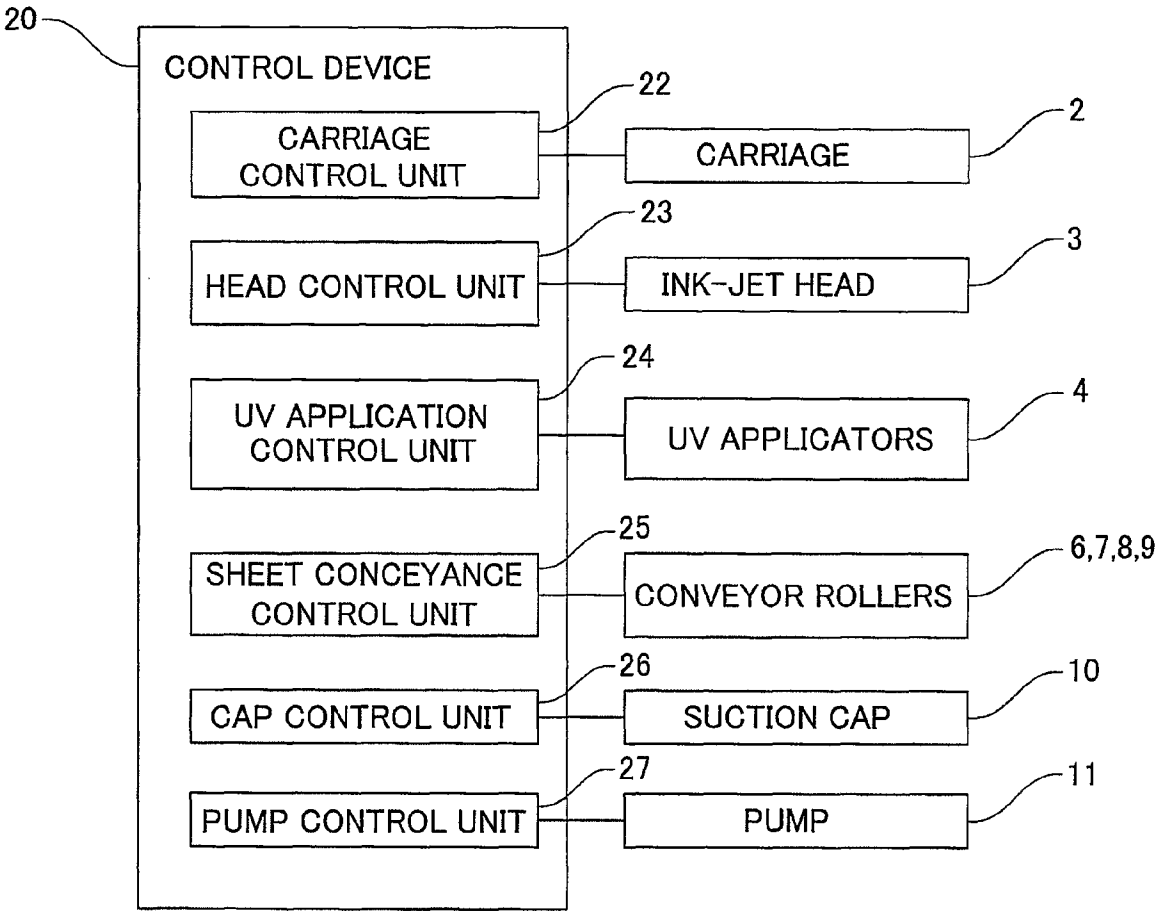
FIG. 4 is a block diagram of a control device of FIGS. 1A, 1B.

The following describes the control device 20 which controls the operation of the printer 1. FIG. 4 is a block diagram of the control device 20. As described later, the printer 1 is capable of performing: a printing process onto a recording sheet P; a flushing process; a purging process; a process of curing ink reserved in the waste tank 12; and the like. The control device 20 controls the operation of each component of the printer 1 when the printer 1 performs these processes. The control device 20 is constituted of: a CPU (Central Processing Unit); a ROM (Read Only Memory); a RAM (Random Access Memory); and the like. These members function as a carriage control unit 22, a head control unit 23, a UV application control unit 24, a sheet conveyance control unit 25, a cap control unit 26, a pump control unit 27, and the like.

The carriage control unit 22 controls the operation of the carriage 2 at the time of the printing process onto a recording sheet P, the flushing process, the purging process, the process of curing ink in the waste tank 12, and the like. The head control unit 23 controls the operation of the ink-jet head 3 at the time of the printing process onto a recording sheet P, the flushing process, the purging process, and the like.

The UV application control unit 24 controls the operation of the UV applicators 4 at the time of the printing process on a recording sheet P, the process of curing ink in the waste tank 12, and the like. The sheet conveyance control unit 25 controls the operations of the conveyor rollers 6 to 9 at the time of the printing process onto a recording sheet P, and the like. The cap control unit 26 controls the operation of the suction cap 10 at the time of the purging process, and the like. The pump control unit 27 controls the operation of the pump 11 at the time of the flushing process, the purging process, and the like.

Next, explanation will be given on the operations of the printer 1 at the time of the printing process onto a recording sheet P, the flushing process, the purging process, and the process of curing ink reserved in the waste tank 12, respectively.

First, explanation will be given on the operation of printer 1 in the printing process onto a recording sheet P. When the printing process onto a recording sheet P is performed in the printer 1, control is exercised by the control device 20 in the following manner. As shown in FIG. 3A, the conveyor rollers 6 to 9 are controlled so as to convey the recording sheet P in the paper feed direction. Then, when the recording sheet P arrives at a position where the sheet P faces the carriage 2, the ink jet head 3 moving with the carriage 2 in the scanning direction is controlled so as to eject ink, so that the ink is landed onto the recording sheet P. Then, the UV applicators 4 which also move with the carriage 2 in the scanning direction are controlled so as to apply ultraviolet light, and thereby the ink landed onto the recording sheet P is cured. Thus, printing is conducted on the recording sheet P. Note that, the recording sheet P is supported by the platen 5 during this process.

In this process, since the UV applicators 4 are respectively disposed on both sides of the ink jet head 3 in the scanning direction, it is possible to immediately cure the ink landed onto the recording sheet P using ultraviolet light applied from one of the UV applicators 4, which is located upstream in a moving direction of the carriage 2. This allows the ink to be cured in the course of permeation through the recording sheet P. Therefore, it is possible to prevent an edge of a printed image from being blurred.

Next, explanation will be given on the operation of the printer 1 in the flushing process. When the flushing process is performed in the printer 1, control is exercised by the control device 20 in the following manner. The carriage 2 is moved to a position where the ink-jet head 3 faces the suction cap 10. Then, in this state where the ink jet head 3 does not face a recording sheet P, the ink-jet head 3 is controlled so as to eject ink toward the suction cap 10. This allows viscous ink or the like in the nozzles 15 to be discharged to the suction cap 10. Thereafter, the pump 11 is driven. With this, the ink discharged to the suction cap 10 is transferred to the waste tank 12.

Next, explanation will be given on the operation of the printer 1 in the purging process. When the purging process is performed in the printer 1, control is exercised by the control device 20 in the following manner. First, the carriage 2 is moved to a position where the ink-jet head 3 faces the suction cap 10. Then, in this state, the suction cap 10 is moved upward, so that the nozzle surface of the ink jet head 3 is covered with the suction cap 10, and subsequently the pump 11 is driven. Thereby, through the suction cap 10, viscous ink or foreign matters in the ink-jet head 3 is sucked from the nozzles 15, that is, forced to be discharged, and the sucked ink is transferred to the waste tank 12.

Next, explanation will be given on the operation of the printer 1 in the process of curing ink in the waste tank 12. When the process of curing ink in the waste tank 12 is performed in the printer 1, control is exercised by the control device 20 in the following manner. As shown in FIG. 3B, without a recording sheet P placed on the platen 5, the UV applicators 4 are controlled so as to apply ultraviolet light to the waste tank 12. More specifically, as a result that ultraviolet light is applied from the UV applicators 4 to the platen 5, the applied ultraviolet light passes through the transparent platen 5 and reaches below the platen 5, i.e., a position opposite to the UV applicators 4 with the platen 5 interposed therebetween, and consequently the ultraviolet light is applied to the waste tank 12. Thus, the ultraviolet light is applied to the ink in the waste tank 12, and the ink in the waste tank 12 is cured.

If ink in the waste tank 12 remains uncured, the ink in the waste tank 12 possibly leaks to the outside, for example when carrying the printer 1. However, in this embodiment, the ink in the waste tank 12 is cured by ultraviolet light applied from the UV applicators 4 to the waste tank 12, as described above. This makes it possible to prevent the ink in the waste tank 12 from leaking to the outside.

Further, in this embodiment, ultraviolet light is applied from the UV applicators 4 to the waste tank 12 immediately after the above flushing process and immediately after the purging process. As a result of the flushing or purging process, a relatively large amount of ink is discharged to the waste tank 12. If this ink remains uncured, the ink in the waste tank 12 is likely to leak to the outside, for example when carrying the printer 1.

However, in this embodiment, ultraviolet light is applied from the UV applicators 4 to the waste tank 12 immediately after the flushing process and immediately after the purging process, as described above. This makes it possible to immediately cure ink discharged to the waste tank 12 in the flushing or purging process. Therefore, it is possible to surely prevent the ink in the waste tank 12 from leaking to the outside, for example when carrying the printer 1.

Furthermore, in this embodiment, ultraviolet light is applied to the waste tank 12 using the UV applicators 4, which are for applying ultraviolet light to a recording sheet P having ink landed thereon, as described above. That is, in this embodiment, the UV applicators 4 functioning as the first light applicator also serve as the second light applicator. Accordingly, there is no need to provide another UV applicator used exclusively for applying ultraviolet light to the waste tank 12, separately from the UV applicators 4. This makes the structure of the printer 1 simple.

Moreover, in this embodiment, the platen 5 is transparent, and the waste tank 12 is disposed below the platen 5, i.e., is disposed opposite to the UV applicators 4 with the platen 5 interposed therebetween. Therefore, when ultraviolet light is applied from the UV applicators 4 to the platen 5 without a recording sheet P placed on the platen 5, the ultraviolet light passes through the platen 5 and applied to the waste tank 12. Accordingly, ultraviolet light can be easily applied to the waste tank 12 using the UV applicators 4, which are for applying ultraviolet light to a recording sheet P.

In addition, the platen 5 configured to be transparent contributes to easily construct a structure such that ultraviolet light applied from the UV applicators 4 reaches below the platen 5, i.e., a position opposite to the UV applicators 4 with the platen 5 interposed therebetween.

The following describes modifications of this embodiment, with various changes from the embodiment. Note that, components of the same structure as in this embodiment will be given the same reference numerals, and the description thereof will be omitted, if appropriate.

Figure 5:
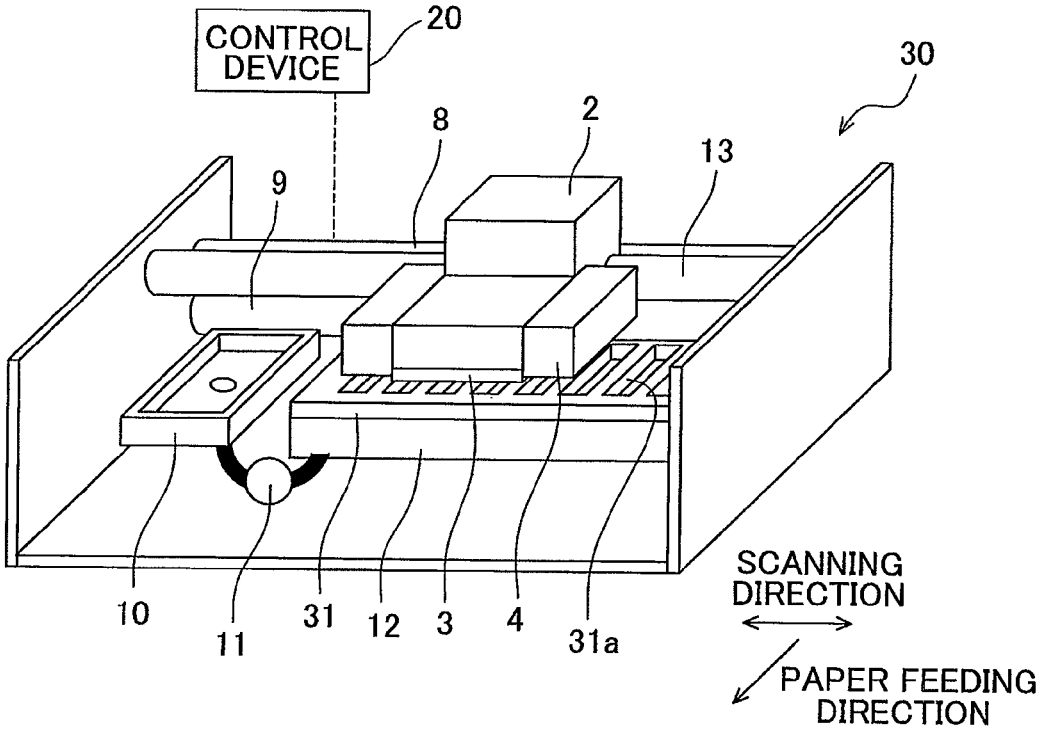
FIG. 5 is a diagram of a first modification, corresponding to FIG. 1B.

In one modification, as shown in FIG. 5, a printer 30 has a configuration such that: a platen 31 is not transparent, that is, the platen 31 is not made of light transmissive material; and the platen 31 has a plurality of slits 31*a*. Each of the slits 31*a* extends in a paper feed direction and penetrates the platen 31 in its thickness direction from an upper surface to an under surface of the platen 31. In addition, the slits 31*a* are arranged in a scanning direction (a first modification).

At the time of curing ink in a waste tank 12 in this modification, ultraviolet light is applied from UV applicators 4 to the waste tank 12, while a carriage 2 is moved in the scanning direction. To be more specific, as a result that ultraviolet light is applied from the UV applicators 4 to the platen 31, the applied ultraviolet light passes through the slits 31*a* and reaches below the platen 31, i.e., a position opposite to the UV applicators 4 with the platen 31 interposed therebetween, and consequently the light is applied to the waste tank 12 disposed below the platen 31. Thereby, the ultraviolet light is applied to the ink in the waste tank 12, and the ink in the waste tank 12 is cured.

In this case, the slits 31*a* formed in the platen 31 contributes to easily construct a structure such that ultraviolet light applied from the UV applicators 4 reaches below the platen 31.

Figure 6:
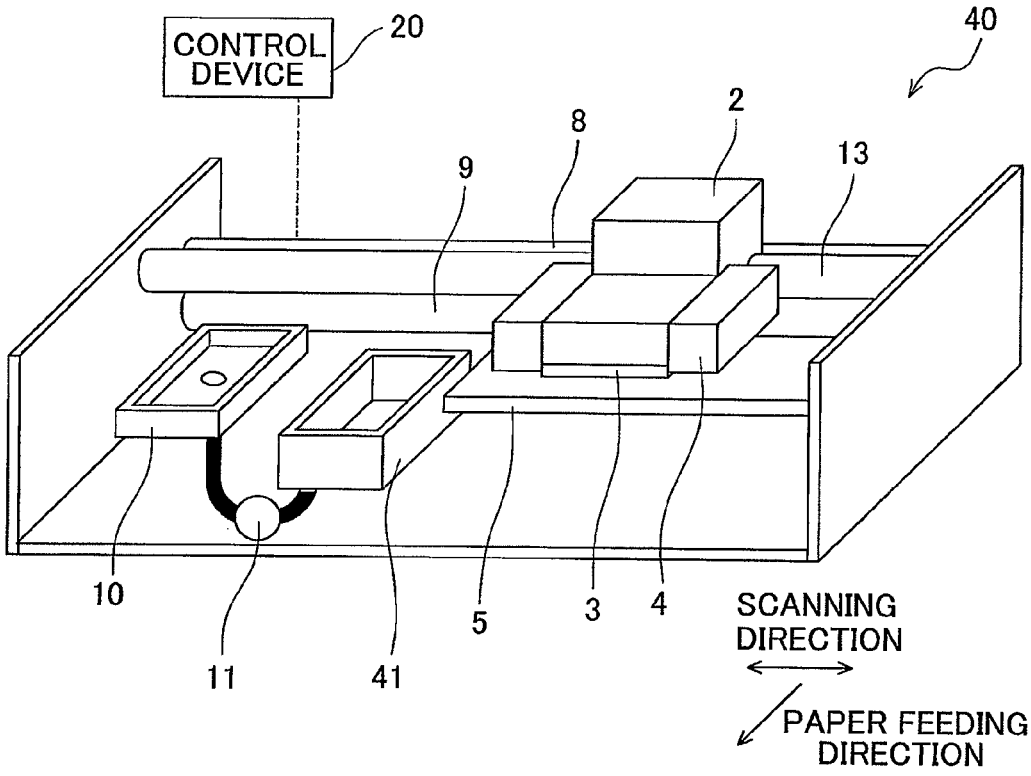
FIG. 6 is a diagram of a second modification, corresponding to FIG. 1B.

In another modification, as shown in FIG. 6, a printer 40 has a configuration such that an open-topped waste tank 41 is disposed at the left of a platen 5, i.e., adjacent to the platen 5 with respect to a scanning direction. It should be noted that the platen 5 does not have to be transparent in this modification (a second modification).

In this case, since the waste tank 41 is disposed adjacent to the platen 5 with respect to the scanning direction, it is possible to cure ink reserved in the waste tank 41 in the following way: ultraviolet light is applied from UV applicators 4 after the UV applicators 4 are moved with a carriage 2 in the scanning direction to a position where the UV applicators 4 face the waste tank 41.

Thus, the ink in the waste tank 41 can be cured using the UV applicators 4 which are for curing ink landed on a recording sheet P. Accordingly, there is no need to provide another UV applicator used exclusively for applying ultraviolet light to ink in the waste tank 41, separately from the UV applicators 4. This makes the structure of the printer 40 simple.

Further, in this modification, a flushing process can be performed in a following manner: an ink-jet head 3 is moved with the carriage 2 in the scanning direction to a position where the ink-jet head 3 faces the waste tank 41; and then, in this state where the ink jet head 3 does not face a recording sheet P, the ink-jet head 3 is controlled to eject ink directly to the waste tank 41. This does not require driving a pump 11 in the flushing process, leading to a decrease in power consumption of the pump 11.

The above description deals with a so-called serial-type ink jet head, such as the ink-jet head 3 reciprocating with the carriage 2 in the scanning direction. However, the present invention is not limited thereto.

Figure 7:
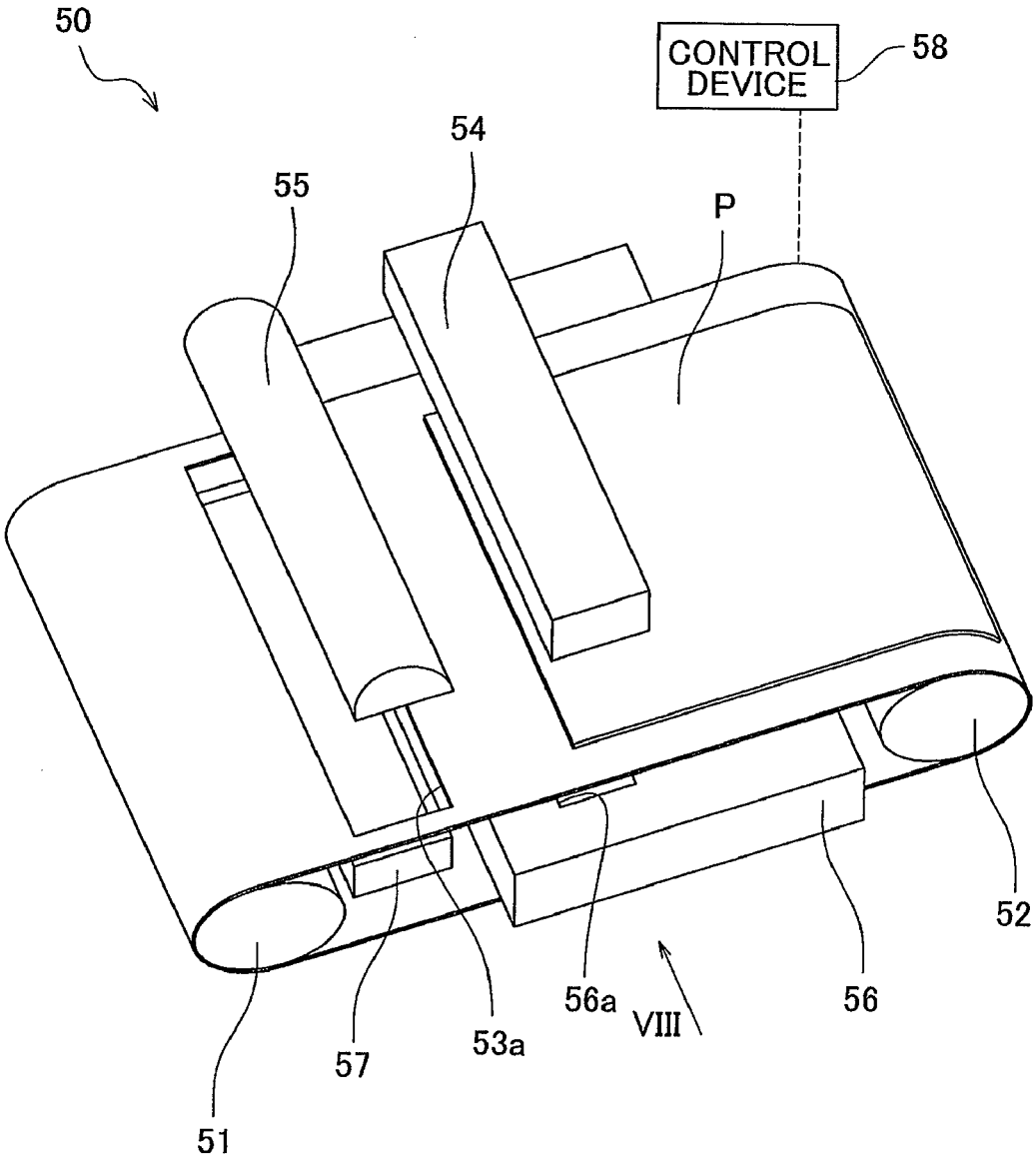
FIG. 7 is a schematic diagram of a printer of a third modification.
Figure 8A:
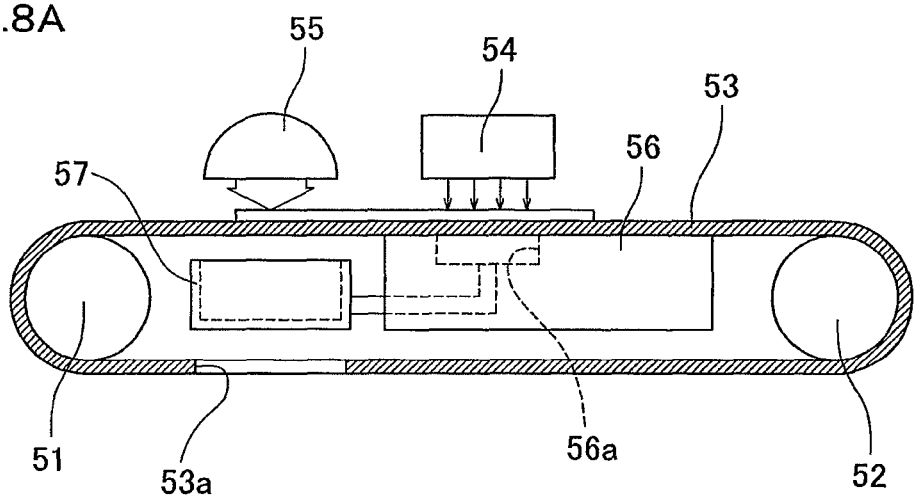
FIG. 8A is a diagram of the printer of FIG. 7 which performs a printing process, viewed from a direction of an arrow VIII in FIG. 7.
Figure 8B:
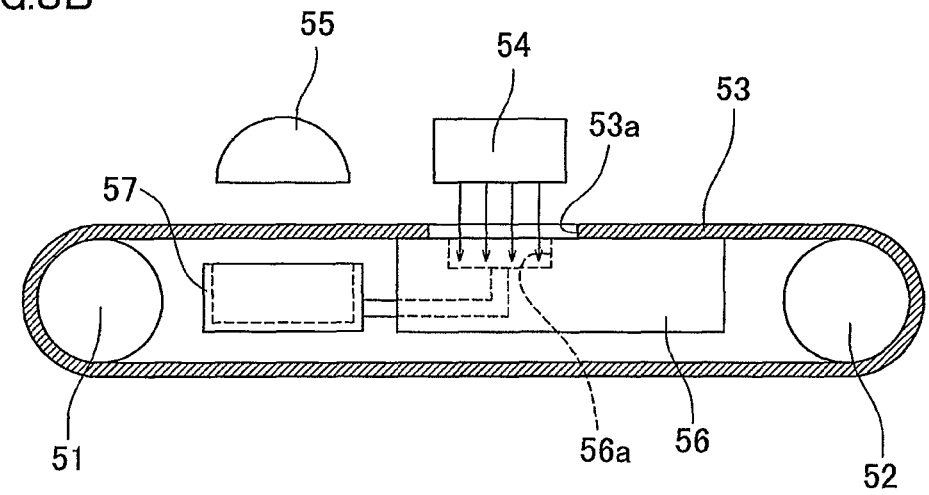
FIG. 8B is a diagram of the printer of FIG. 7 which performs a flushing process, viewed from the direction of the arrow VIII in FIG. 7.
Figure 8C:
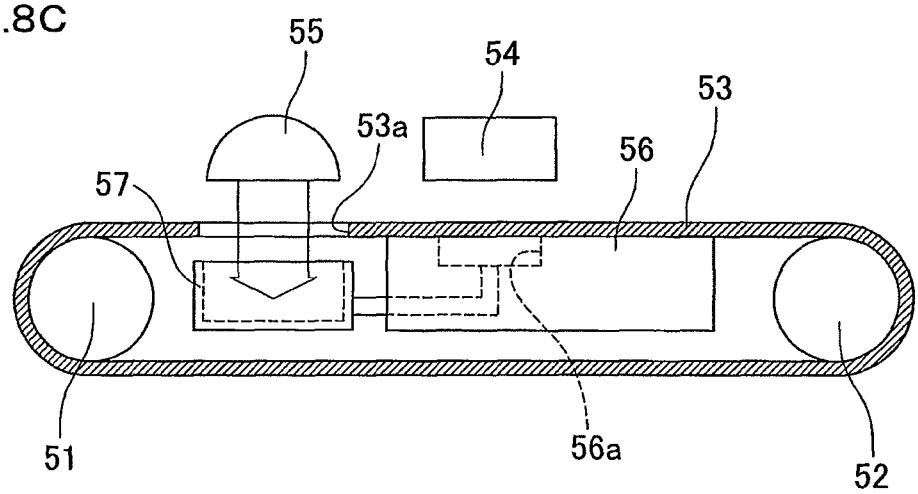
FIG. 8C is a diagram of the printer of FIG. 7 which performs a process of curing ink in a waste tank, viewed from the direction of the arrow VIII in FIG. 7.

FIG. 7 is a schematic diagram of a printer 50 of a third modification which will be described below. FIG. 8A is a diagram of the printer of FIG. 7 which performs a printing process, viewed from a direction of an arrow VIII in FIG. 7. FIG. 8B is a diagram of the printer of FIG. 7 which performs a flushing process, viewed from the direction of the arrow VIII in FIG. 7. FIG. 8C is a diagram of the printer of FIG. 7 which performs a process of curing ink in a later-described waste tank 57, viewed from the direction of the arrow VIII in FIG. 7.

As shown in FIG. 7 and FIGS. 8A to 8C, in the third modification, the printer 50 includes: two conveyor rollers 51 and 52 each having a substantially cylindrical shape; and a belt 53 looped around these rollers. As the conveyor rollers 51 and 52 rotate in a counterclockwise direction, the belt 53 rotates in the counterclockwise direction. As a result, a recording sheet P placed on an upper surface of the belt 53 is conveyed to the left in FIGS. 8A, 8B, 8C. In addition, the belt 53 has a substantially quadrangular through hole 53*a* formed at a part of the belt 53. The through hole 53*a* extends in a widthwise direction of the belt 53, which is a direction perpendicular to the plane of the page of FIGS. 8A to 8C.

In addition, an ink jet head 54 is disposed so as to face the upper surface of the belt 53. Further, a UV applicator 55 is disposed downstream from the ink jet head 54 in a moving direction of the belt 53, that is, at the left of the ink-jet head 54 in FIGS. 8A, 8B, 8C. Here, the ink jet head 54 is a so-called line-type head, which extends in the widthwise direction of the belt 53 and has the substantially same length as the width of a recording sheet P to be conveyed by the belt 53. The UV applicator 55 also extends in the widthwise direction of the belt 53 and has the substantially same length as the width of the recording sheet P. The above-mentioned through hole 53*a* extends in the widthwise direction of the belt 53 and has the same length as that of the ink jet head 54 and of the UV applicator 55.

Inside the belt 53 looped around the conveyor rollers 51 and 52, a platen 56 for supporting a recording sheet P with the belt 53 is disposed so that the platen 56 faces the ink jet head 54. An open-topped ink receiver 56*a* is formed at a portion of the platen 56 which vertically overlaps the ink-jet head 54. At the left of the platen 56 in FIGS. 8A, 8B, 8C, the open-topped waste tank 57 is disposed so that the waste tank 57 faces the UV applicator 55. In addition, the ink receiver 56*a* is connected to the waste tank 57.

The operation of the printer 50 is controlled by a control device 58. The control device 58 includes: a head control unit 23; a UV application control unit 24; a sheet conveyance control unit 25; and the like, similarly to the control device 20 (see FIG. 4). The head control unit 23 controls the operation of the ink jet head 54, the UV application control unit 24 controls the operation of the UV applicator 55, and the sheet conveyance control unit 25 controls the operations of the conveyor rollers 51 and 52.

The operation of the printer 50 is as follows. As shown in FIG. 8A, the belt 53 rotated by the conveyor rollers 51 and 52 conveys a recording sheet P placed on the belt 53. When the recording sheet P reaches a position where the recording sheet P faces the ink-jet head 54, the ink jet head 54 is controlled so as to eject ink; and when the recording sheet P reaches a position where the recording sheet P faces the UV applicator 55, the UV applicator 55 is controlled so as to apply ultraviolet light. Thus, printing is conducted on the recording sheet P.

Further, as shown in FIG. 8B, when the through hole 53*a* formed in the belt 53 reaches a position where the through hole 53*a* faces the ink-jet head 54 as a result that the belt 53 is rotated by the conveyor rollers 51 and 52, that is, in a state where a recording sheet P does not face the ink-jet head 54, the ink-jet head 54 is controlled so as to eject ink, and thereby a flushing process is performed. The ink ejected in this process passes through the through hole 53*a*, and reaches the ink receiver 56*a*. Then, the ejected ink is transferred from the ink receiver 56*a* to the waste tank 57.

Furthermore, as shown in FIG. 8C, when the through hole 53*a* reaches a position where the through hole 53*a* faces the UV applicator 55 as a result that the belt 53 is rotated by the rotation of the conveyor rollers 51 and 52, the UV applicator 55 is controlled so as to apply ultraviolet light. The ultraviolet light passes through the through hole 53*a* and reaches the waste tank 57. Consequently, it is possible to cure ink in the waste tank 57. This makes it possible to prevent the ink in the waste tank 57 from leaking to the outside, for example when carrying the printer 50.

Here, when the flushing process is performed as described above, a relatively large amount of ink flows from the ink receiver 56*a* to the waste tank 57. Therefore, if the ink in the waste tank 57 remains uncured, the ink in the waste tank 57 is likely to leak to the outside, for example when carrying the printer 50.

However, the UV applicator 55 is disposed downstream from and adjacent to the ink jet head 54 with respect to a moving direction of the belt 53. Therefore, as described above, when the belt 53 is rotated by the conveyor rollers 51 and 52 after the flushing process is performed, the through hole 53*a* soon reaches the position where it faces the UV applicator 55. Accordingly, it is possible to cure ink in the waste tank 57 by applying ultraviolet light from the UV applicator 55 to the waste tank 57, immediately after the flushing process is performed. This makes it possible to surely prevent ink in the waste tank 57 from leaking to the outside.

Also in this modification, to cure ink in the waste tank 57, ultraviolet light is applied to the waste tank 57 from the UV applicator 55 which is for applying ultraviolet light to a recording sheet P having received ink ejected from the ink-jet head 54. That is, the first light applicator of the present invention also serves as the second light applicator of the present invention. Accordingly, there is no need to provide another UV applicator or the like for applying ultraviolet light to the waste tank 57, separately from the UV applicator 55, and this makes the structure of the printer 50 simple.

The printer 50 of the third modification may further include: a suction cap which is connected to the waste tank 57 and is capable of covering the ink-jet head 54; and a pump provided between the waste tank 57 and the suction cap, so that a purging process in which ink in the ink-jet head 54 is forced to be discharged from nozzles to the waste tank 57 can be performed in the following way: the pump is driven with the ink jet head 54 being covered with the suction cap, thereby to suck viscous ink or foreign matters in the ink jet head 54; and then the sucked ink or the like is transferred to the waste tank 57.

In this configuration, a relatively large amount of ink is discharged to the waste tank 57 when the purging process is performed. However, the ink in the waste tank 57 is curable in the same way as described above, i.e., by applying ultraviolet light from the UV applicator 55 to the waste tank 57 immediately after the purging process is performed. With this, it is possible to prevent the ink in the waste tank 57 from leaking to the outside, for example when carrying the printer 50.

Note that, in this case, the suction cap has a following structure, for example. The suction cap is retracted to a not-shown position not to interfere with a printing process or the like, unless the purging process is performed; and the suction cap is moved to a position where it faces the ink-jet head 54 to cover a nozzle surface of the ink jet head 54 only when the purging process is performed.

The above description deals with the case where ultraviolet light is directly applied to the waste tank 12, 57 from the UV applicator(s) 4, 55 for applying ultraviolet light to a recording sheet P having ink landed thereon, and thereby ink in the waste tank 12, 57 is cured. However, the present invention is not limited thereto.

Figure 9:
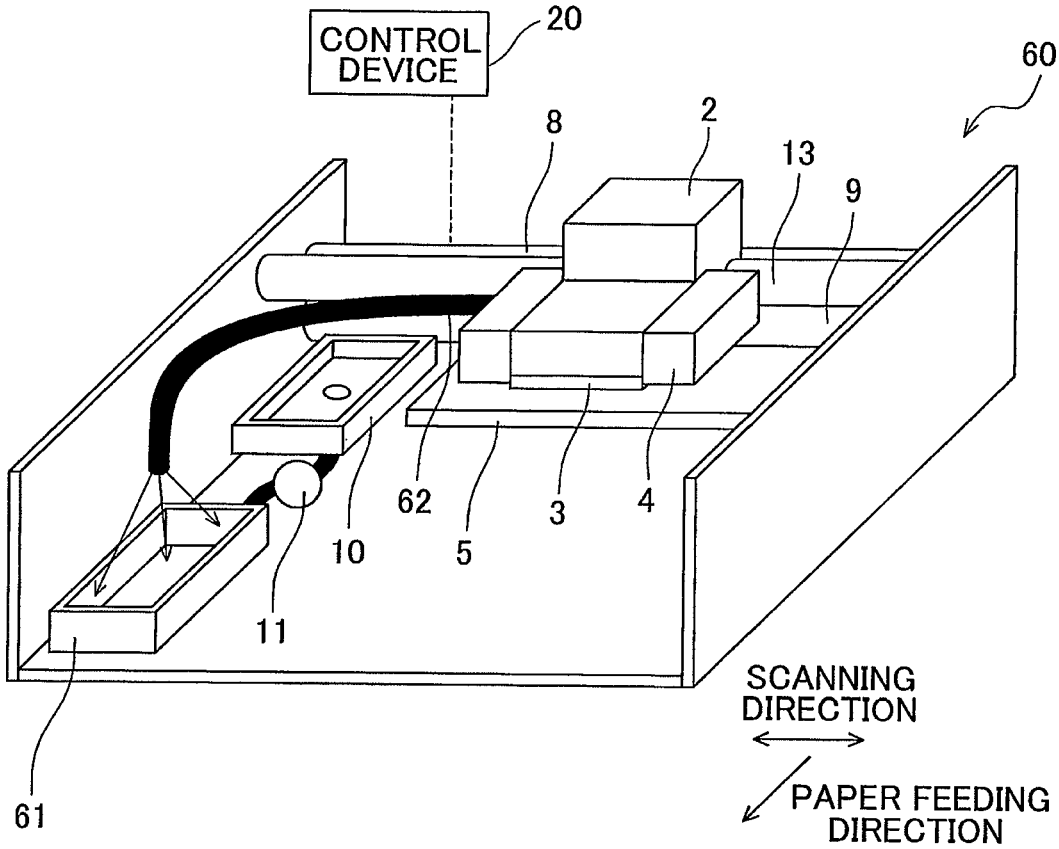
FIG. 9 is a diagram of a fourth modification, corresponding to FIG. 1B.

In another modification, as shown in FIG. 9, a printer 60 is configured so that: a waste tank 61 is disposed closer to a viewer than UV applicators 4 in FIG. 9, and therefore the UV applicators 4 are unable to face the waste tank 61 wherever a carriage 2 is moved to, that is, ultraviolet light is unable to be applied from the UV applicators 4 directly to the waste tank 61. In addition, an optical fiber 62 is connected to the UV applicators 4, and the optical fiber 62 extends to a position above the waste tank 61 so that an end of the optical fiber 62 faces the waste tank 61. Note that, in this modification, a platen 5 does not have to be transparent (a fourth modification).

In this modification, it is possible to cure ink in the waste tank 61 by applying ultraviolet light emitted from the UV applicators 4 to the waste tank 61 via the optical fiber 62 after the flushing process and after the purging process, for example. This makes it possible to prevent the ink in the waste tank 61 from leaking to the outside, for example when carrying the printer 60.

Further, in this modification, since ultraviolet light emitted from the UV applicators 4 is applied to the waste tank 61 via the optical fiber 62, there is no need to provide another UV applicator or the like used exclusively for applying ultraviolet light to the waste tank 61, separately from the UV applicators 4. This enables the structure of the printer 60 to be simple.

Figure 10:
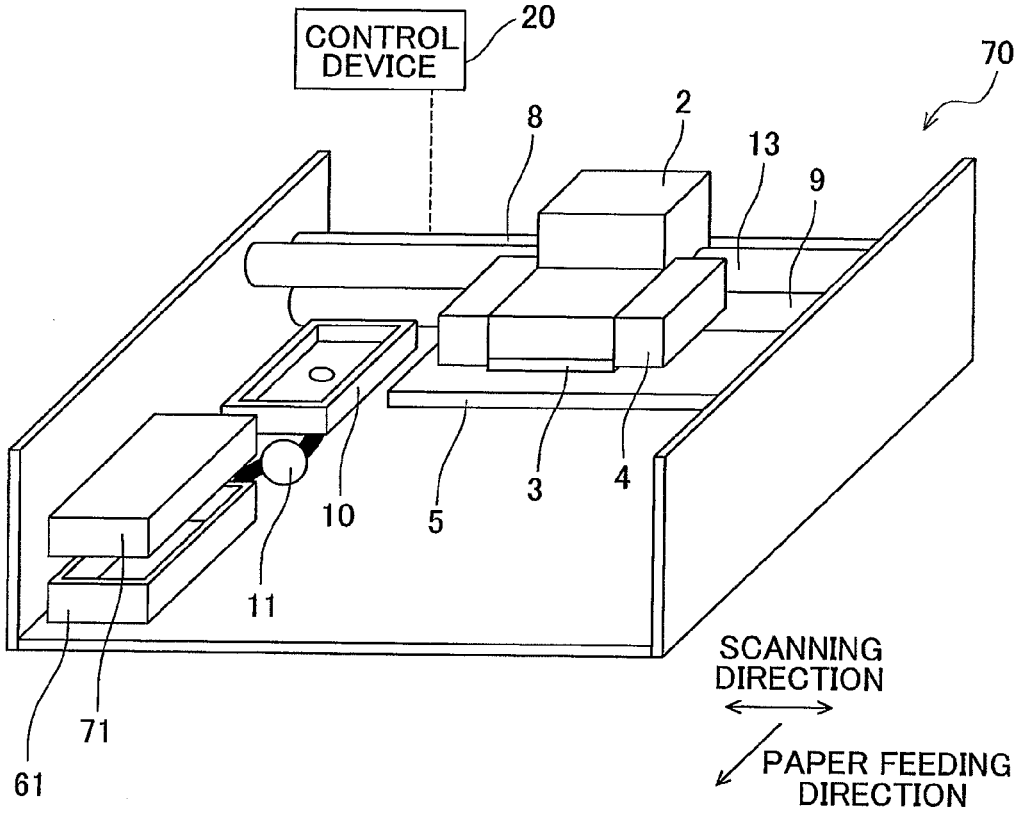
FIG. 10 is a diagram of a fifth modification, corresponding to FIG. 1B.

In still another modification, as shown in FIG. 10, a printer 70 includes: a waste tank 61 similar to that in the fourth modification; and a UV applicator 71 disposed above the waste tank 61 so that the UV applicator 71 faces the waste tank 61. The UV applicator 71 is the second light applicator, different from the UV applicators 4 functioning as the first light applicator (fifth modification). Note that, in the fifth modification, a UV application control unit 24 of a control device 20 (see FIG. 4) controls the operations of the UV applicators 4 and the UV applicator 71.

In this modification, it is possible to cure ink in the waste tank 61 by applying ultraviolet light from the UV applicator 71 to the waste tank 61 after a flushing process and after a purging process, for example. This makes it possible to prevent the ink in the waste tank 61 from leaking to the outside, for example when carrying the printer 70.

However, in this modification, it is necessary to provide the UV applicator 71 which is the second light applicator and used exclusively for applying ultraviolet light to the waste tank 61, separately from the UV applicators 4 functioning as the first light applicator for applying ultraviolet light to a recording sheet P having ink landed thereon.

In the above-described embodiment, ultraviolet light is applied from the UV applicators 4 to the waste tank 12 immediately after the flushing process and immediately after the purging process. However, the present invention is not limited thereto. For example, such a configuration may be possible that ultraviolet light is applied from the UV applicators 4 to the waste tank 12 immediately after the purging process but ultraviolet light is not applied from the UV applicators 4 to the waste tank 12 immediately after the flushing process.

As a result of the purging process, a very large amount of ink is discharged to the waste tank 12. Therefore, if the ink in the waste tank 12 remains uncured, the ink in the waste tank 12 is likely to leak to the outside. However, in the case where the ink in the waste tank 12 is cured by applying ultraviolet light from the UV applicators 4 to the waste tank 12 immediately after the purging process, it is possible to prevent the ink in the waste tank 12 from leaking to the outside.

On the other hand, as a result of the flushing process, a relatively large amount of ink is discharged to the waste tank 12, however, the amount of ink is smaller than the amount of ink discharged in the purging process. Therefore, even if the ink in the waste tank 12 remains uncured after the flushing process, it is less likely that the ink in the waste tank 12 leaks to the outside, compared with the case where ink discharged to the waste tank 12 in the purging process remains uncured.

Therefore, such a structure that ultraviolet light is not applied from the UV applicators 4 to the waste tank 12 immediately after the flushing process contributes a reduction in power consumption of the UV applicators 4. In this structure, using ultraviolet light applied from the UV applicators 4 to the waste tank 12 immediately after the purging process, it is possible to cure ink discharged to the waste tank 12 in the purging process, as well as ink discharged to the waste tank 12 in the flushing process performed before the purging process.

In addition, the timing at which ultraviolet light is applied from the UV applicators 4 to the waste tank 12 does not have to be immediately after the flushing process and/or immediately after the purging process. For example, ultraviolet light may be applied from the UV applicators 4 to the waste tank 12 at intervals of a predetermined period of time.

The foregoing describes an example in which the present invention is applied to a printer which ejects UV curable ink from an ink-jet head to a recording sheet thereby conducts printing on the recording sheet. However, the present invention is also applicable to a liquid ejection apparatus which ejects photo-curable liquid other than ink to an ejection target other than a recording sheet.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus, comprising:

a liquid ejection head which ejects photo-curable liquid from nozzles;

a first light applicator which applies light to an ejection target having received liquid ejected by the liquid ejection head;

a waste tank which reserves therein liquid discharged from the liquid ejection head;

a second light applicator which applies light to liquid in the waste tank; and a support member which supports the ejection target from a side opposite to the liquid ejection head and the first light applicator, wherein the first light applicator also serves as the second light applicator, wherein the waste tank is disposed opposite to the first light applicator with the support member interposed therebetween, and wherein the support member is configured so that light applied from the first light applicator to the support member passes through the support member and reaches a position opposite to the first light applicator with the support member interposed therebetween.

2. The liquid ejection apparatus according to claim 1, wherein the support member is made of light transmissive material.

3. The liquid ejection apparatus according to claim 1, wherein the support member has a slit formed therein, the slit penetrating the support member to extend from a surface of the support member close to the first light applicator to an opposite surface of the support member from the first light applicator.

4. The liquid ejection apparatus according to claim 1, further comprising a control device which controls the liquid ejection head, the first light applicator, and the second light applicator.

5. The liquid ejection apparatus according to claim 4, wherein:

the control device controls the liquid ejection head not facing the ejection target so as to eject liquid from the nozzles, thereby to perform a flushing process of discharging liquid contained in the liquid ejection head to the waste tank; and the control device controls the second light applicator so as to apply light to liquid in the waste tank immediately after controlling the liquid ejection head so as to perform the flushing process.

6. The liquid ejection apparatus according to claim 4, further comprising a purging mechanism which is controlled by the control device and performs a purging process in which liquid in the liquid ejection head is forced to be discharged from the nozzles to the waste tank, wherein the control device controls the second light applicator so as to apply light to liquid in the waste tank immediately after controlling the purging mechanism so as to perform the purging process.

* * * * *